US005142979A

United States Patent [19]

Funada et al.

[11] Patent Number: 5,142,979

[45] Date of Patent: Sep. 1, 1992

[54] SAFETY DEVICE FOR PRINTING MACHINE

[75] Inventors: Hitoshi Funada, Chiba; Toshi Ojima, Toride, both of Japan

[73] Assignee: Komori Corporation, Tokyo, Japan

[21] Appl. No.: 815,574

[22] Filed: Dec. 27, 1991

Related U.S. Application Data

[63] Continuation of Ser. No. 700,872, May 10, 1991, abandoned, which is a continuation of Ser. No. 485,300, Feb. 26, 1990, abandoned.

[30] Foreign Application Priority Data

Sep. 9, 1988 [JP] Japan ..... 63-224582
Sep. 9, 1988 [JP] Japan ..... 63-224583

[51] Int. Cl.[5] ..... B41F 5/18; B41F 31/30; B41F 33/12

[52] U.S. Cl. ..... 101/183; 101/352

[58] Field of Search ..... 101/182-185, 101/220, 221, 206, 209, 351, 352, 178-181, 53, 216, 247; 49/26-28; 83/DIG. 1; 192/129 A, 129 R; 408/710; 200/86 R, 86.5, 334, DIG. 35

[56] References Cited

U.S. PATENT DOCUMENTS 3,832,178 7/1975 Staamann ..... 101/182
4,150,269 4/1979 Henkel ..... 200/86.5
4,222,325 9/1980 Edwards ..... 101/185
4,744,307 5/1988 Peterman et al. ..... 200/86.5

*Primary Examiner*—J. Reed Fisher
*Attorney, Agent, or Firm*—Abelman Frayne & Schwab

[57] ABSTRACT

A printing press having a horizontally stationary printing head and at least one horizontally moveable inking unit is provided with a safety system that disables the main motor drive to the printing head prior to retraction of the or each inking unit, and which inhibits movement of the inking unit in the retract direction in the presence of an operator or tools positioned behind the inking unit, while permitting movement of the inking unit in an advanced direction in the absence of an operator and tools positioned between the retracted inking unit and the printing head.

6 Claims, 3 Drawing Sheets

SAFETY DEVICE FOR PRINTING MACHINE

This application is a continuation of Ser. No. 700,872 filed May 10, 1991, now abandoned, which is a continuation of Ser. No. 485,300, filed Feb. 26, 1990, now abandoned.

FIELD OF THE INVENTION

The present invention relates to a safety device for printing machines, and particularly to a safety device of a type effectively applied to a printing machine of such a type that an ink device unit is moved to any away from the body of the printing machine.

DESCRIPTION OF THE PRIOR ART

In a multiple color printing machine adapted to be used for printing banknotes, bonds or the like, a plurality of plate cylinders are arranged around blanket cylinders in a satellite configuration. Such a kind of printing machines have a complicated structure using a plurality of plate cylinders vertically arranged, so that a suitable working space should be ensured by separating an ink device for supplying ink to the plate cylinders apart from a printing machine body in order to enhance the workability during replacement of printing plates, cleaning of the machine and so forth. Heretofore, there has been proposed a printing machine in which an ink device can be moved to and away from a printing machine body in order to easily mount and remove the ink device unit.

FIG. 1 is a schematic view showing an ink device unit movable type printing machine of the above-mentioned kind. As shown in FIG. 1, this printing machine 11 comprises a paper feed device 12, a printing machine body 13, a paper discharge device 14, a paper feed side ink device unit 15, a paper discharge side ink device unit 16, the paper feed device 12 and the paper discharge device 13 being coupled together by means of a pair of left and right beds 17 which are laid on a floor surface 10. In the printing machine body 13, blanket cylinders 18, 19 are journalled in a juxtaposed relation and are rotated by a main motor (which is not shown), and a plurality of plate cylinders 20, 21 which are similarly rotated by the main motor are arranged around the peripheral surfaces of the blanket cylinders 18, 19 in a satellite configuration, each blanket cylinder being contiguous with four plate cylinders.

The paper feed side ink device unit 15 and the paper discharge side ink device unit 16 arranged on both sides of the printing machine body 13, are set on rails 22 which are laid on the beds 17, respectively, through the intermediary of several rolls 23, and accordingly, they can be moved along the rails 22 to and from the printing machine body 13. Each of the ink device units 15, 16 comprises a plurality of ink devices 24 and a plurality of water feed devices 25, which are associated with the plurality of plate cylinders 21, 22. These ink devices 24 and water feed devices 25 have their final rollers which are made to be contiguous with the plate cylinders 20, 21 when the ink device unit 15, 16 are moved to and then coupled with the printing machine body 13. Thus, the above-mentioned final rollers are made to be contiguous with the plate cylinders 21, 20 which are therefore fed with ink during printing.

Incidentally, the above-mentioned printing machine is adapted to print on both side surfaces of a sheet, simultaneously at one time, and accordingly, the ink device units 15, 16 are arranged on both sides of the printing machine body 13, respectively. However, in the case of a printing machine of a type in which only one side surface of a sheet is printed, it is sufficient to arrange only one ink device unit on one side of the printing machine body.

In the above-mentioned printing machine, during preparation of printing, such as replacement of printing plates, positional alignment, cleaning of the printing machine body, cleaning of the ink device units 15, 16, run-in operation or the like, the ink device units 15, 16 are retracted so as to be moved away from the printing machine body 13. Meanwhile, during printing operation, the ink device units 15, 16 are advanced toward the printing machine body 13 from the above-mentioned position so as to be coupled with the printing machine body 13.

In the above-mentioned arrangement, an electrical, motor, a hydraulic cylinder or the like is usually used as a drive source for extending and retracting the ink device units 15, 16, and operating buttons for controlling the drive source is arranged in the front of the printing machine body 13. In particluar, in a large size printing machine having this arrangement, which is handled by a plurality of operates who manipulate the printing machine, simultaneously, there is such a risk that an operator accidentally moves the ink device units 15, 16 even though there are operators working in front and rear of the ink device units 15, 16. If the ink device units 15, 16 are moved when operators works in front and rear of the ink device units 15, 16, the units bumps upon the operators who are therefore caught between the ink device units 15, 16 and the printing machine body 13 in the worst case.

In order to avoid incurring the above-mentioned risk, a warning buzzer is energized during movement of the ink device units 15, 16, or control is made in such a way that the ink device units 15, 16 are once at positions which are 300 mm distant to the extremities of the advancing and retracting strokes thereof.

However, there is a possibility of such a risk that operators fail to escape in the case of the warning buzzer since the buzzer issues an alarm simultaneously with the movement of the ink device units 15, 16. Further, there is a possibility of a bump upon the ink device units 15, 16 at positioned before and after the once stopping positions in the case of the one-stop control since the one-stop control is effective only at the once stopping position. Further, tbe operating buttons should be again operated while visually observing the destinations of the ink device units 15, 16. Accordingly, this operation of the printing machine gives a troublesome work.

Further, the preparation works for pinting include, in addition to the above-mentioned works, adjustment for an incorrect paper detecting device, adjustment to the speed of a suction wheel, the pressure of air and the like, which are carried out while rotating the blanket cylinders 18, 19, the plate cylinders 20, 21 and the like. At this time, the cylinders 18, 19, 20, 21 are rotated at high speeds, being exposed directly to the operators, and accordingly, there is a possibility of an accident such that the operators are caught between the cylinders.

In order to prevent the above-mentioned accident, the provision of covers surrounding the cylinders 18, 19, 20, 21 have been proposed. However, in this case, the covers should be removed before the ink device units 15, 16 being coupled with the printing machine body 13, and accordingly, the removal of the covers is troublesome.

Further, in order to prevent the above-mentioned accident, it has been also proposed to control the main motor so that the cylinders 18, 19, 20, 21 are rotated at high speeds only after the ink device units 15, 16 are coupled with the printing machine body 13. Even with this case, the ink device units 15, 16 should be coupled with the printing machine body 13 each time when the cylinders 18, 19, 20, 21 are rotated during preparation of printing, and accordingly, the working effeciency is lowered.

SUMMARY OF THE INVENTION

The present invention is devised in view of the above-mentioned problems inherent to the prior art, and accordingly a first object of the present invention is to provide a safety device for printing machines, which can prevent such an accident caused by rotation of printing cylinders during any of various kinds of preparation of printing in such a condition ink device units are made apart from a printing machine body.

A second object of the present invention is to provide a safety device which can prevent accident from occurring during movement of the ink device units.

To the end, according to the present invention, there is provided a safety device for a printing machine in which an ink unit device for supplying ink to a printing machine body having plate cylinders and the like adapted to be driven by a main motor, is arranged so as to be moved in a horizontal direction by a moving means to and from the printing machine body, characterized by a sensor disposed below the ink device unit during the ink device unit being coupled with the printing machine body, for detecting the presence of an operator who exists on said sensor;

a control means for locking the drive of the above-mentioned main motor when the above-mentioned sensor detects the presence of the operator on said sensor;

sensors disposed respectively at positions below the ink device unit during coupling with the printing machine body and below the same during being apart from the printing machine body, for detecting the presence of an operator at the positions;

a lock means for locking the drive of the moving means when the above-mentioned sensors detect the presence of the operator.

DETAILED DESCRIPTION OF PREFERRED EMBODIMENT

Figure 1:
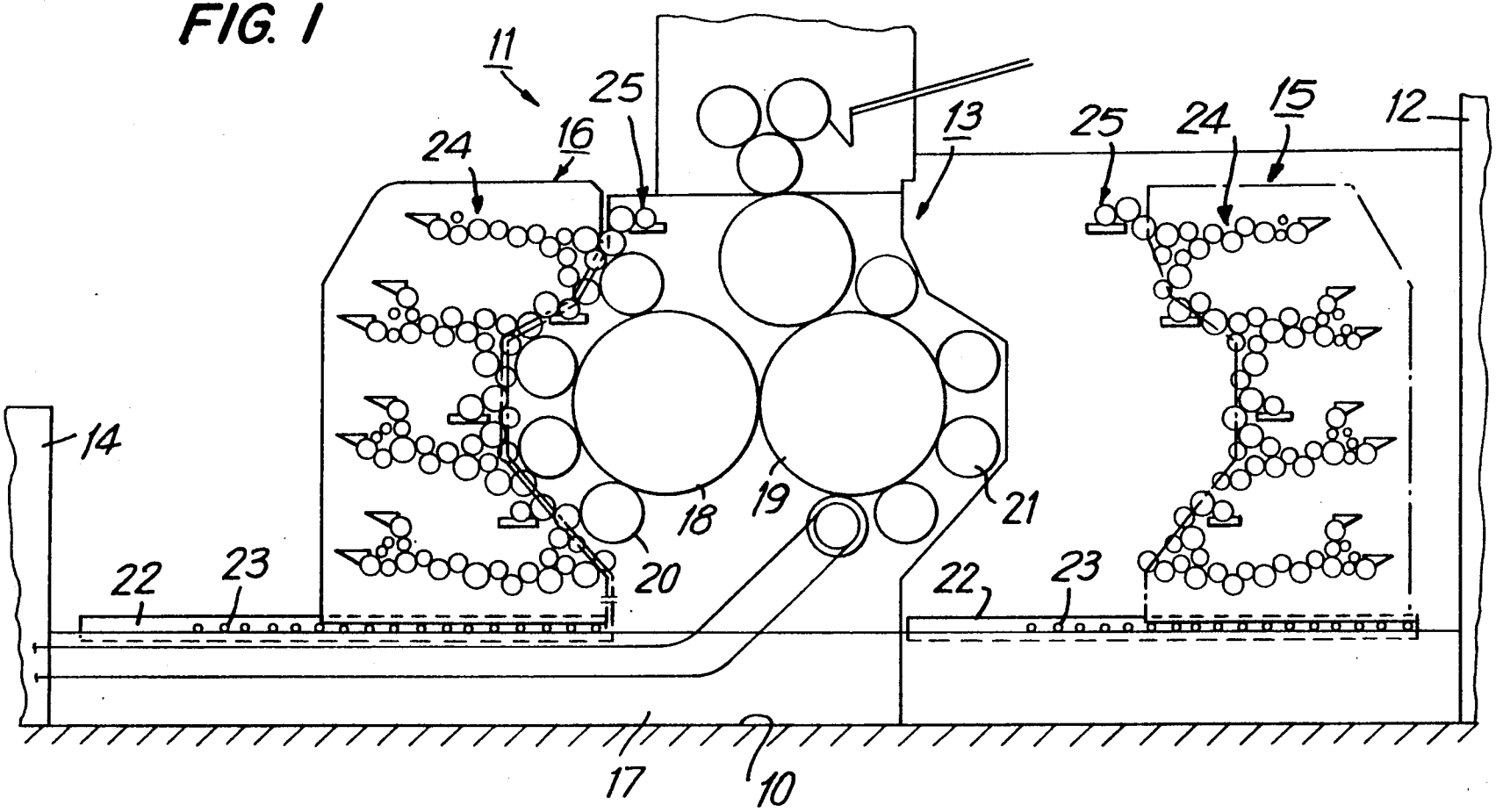
FIG. 1 is a view illustrating a conventional printing machine.
Figure 2:
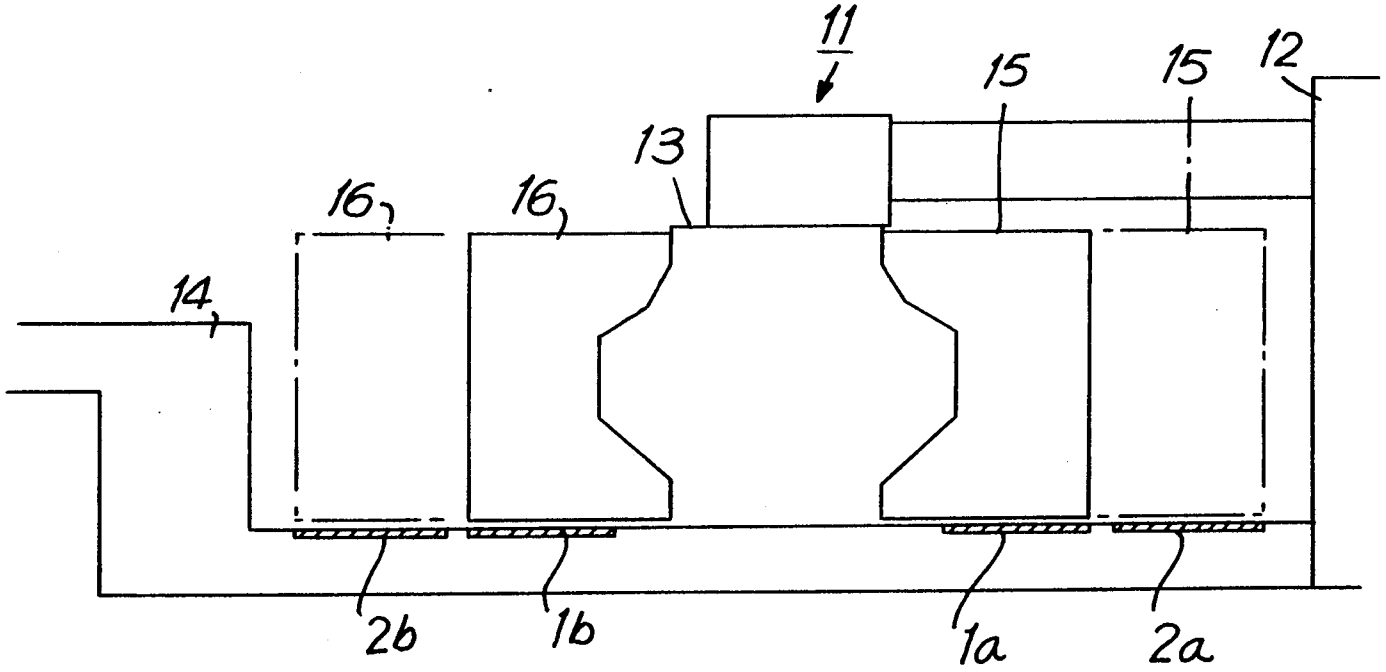
FIG. 2 is a concenptionally explanatory view illustrating a printing machine to which an embodiment of the present invention is applied.

An embodiment of the present invention will be hereinbelow detailed with reference to the accompanying drawings. Referring to FIG. 2 in which the like reference numeral are used to denote the like parts to those shown in FIG. 1 which shows the arrangement of the prior art of the present invention, mat switches 1*a*, 1*b* are located respectively at positions below ink device units 15, 16 during the ink device units 15, 16 being coupled with a printing machine body 13, and are adapted to be turned on if operators or the like exist at the positions so as to detect the presence of the operators on the mat switches 1*a*, 1*b*. Mat switches 2*a*, 2*b* are disposed respectively at positions below the ink device units 15, 16 which are made apart from the printing machine body 13, and are adapted to be turned on if operators or the like exist at the positions so as to detect the presence of the operators on, the mat switches 2*a*, 2*b*.

Figure 3:
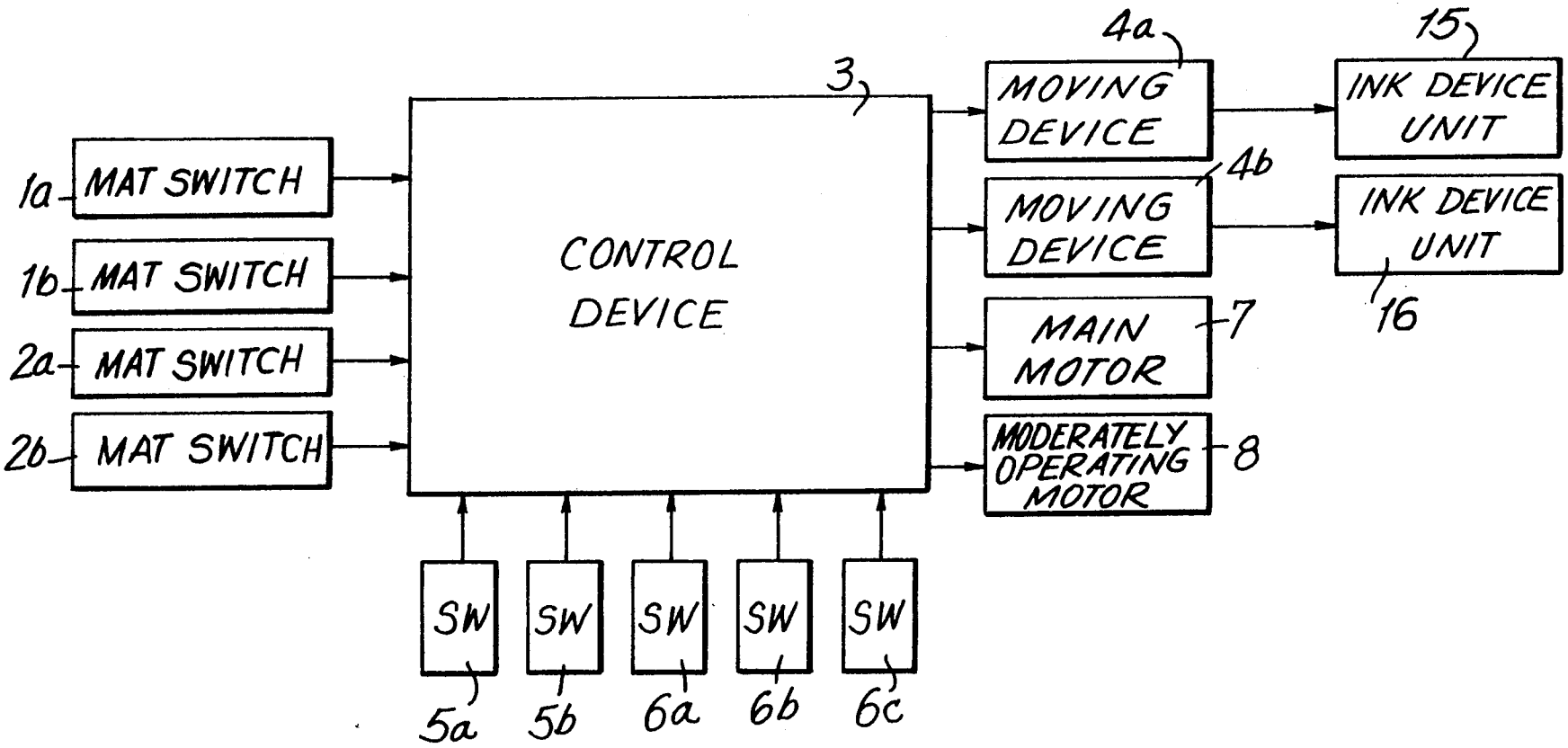
FIG. 3 is a block diagram view explaining the embodiment of the present invention shown in FIG. 1.

FIG. 3 is a block diagram explaining the safe device in this embodiment. As shown, a control device 3 inhibits the drive of moving devices 4*a*, 4*b* when an operator stands on any one of the above-mentioned mat switches 1*a*, 1*b*, 2*a*, 2*b*, which is therefore turned on, but allows the drive of the moving devices 4*a*, 4*b* when push button switches 5*a*, 5*b* are manipulated if it is in a condition other than that the above-mentioned condition of inhibition is established. In order to enhance the working efficiency, the logic of this lock condition is selected such that the ink device units 15, 16 are allowed to be moved rearward (toward the sides remote from the printing machine body 13) in the case of the presence of the operator in front of (on the printing machine body 13 side) of the ink device units 15, 16, that is, during turn-on of the mat switches 1*a*, 1*b*, and that the ink device units 15, 16 are allowed to be moved forward (toward the printing machine body 13) in the case of the present of the operator in rear of the ink device units 15, 16, that is, during turn-on of the mat switches 2*a*, 2*b*. Accordingly, the drive of the moving devices 4*a*, 4*b* is inhibited only when each of the mat switches 1*a*, 1*b*, 2*a*, 2*b* on the way of the advance of the associated ink device unit is turned on.

An electric motor, a hydraulic cylinder or the like is used for each of the moving devices 4*a*, 4*b*, and is adapted to move forward the associated one of the ink device units 15, 16 when the above-mentioned condition of inhibition is not established, in response to the manipulation of the push button switch 5*a* while it is adapted to move rearward the same in response to the manipulation of the push button switch 5*b*.

The control device 3 inhibits the drive of the main motor 7 when either one of the mat switches 1*a*, 1*b* is turned on, but drives the main motor 7 in response to the manipulation of push button switches 6*a*, 6*b* if it is in a condition other than that the above-mentioned condition of inhibition is established.

The main motor 7 is rotated at a high speed upon manipulation of the push button switch 6*a* but at a low speed upon manipulation of the push button switch 6*b* so as to rotate the blanket cylinders 18, 19 and the plate cylinders 20, 21 at predetermined speeds, respectively.

The printing machine 11 includes a moderately operating motor 8 in addition to the main motor 7, which is driven for preparation of printing such as replacement of printing plates, positioning and the like. In more detail, when a push button switch 6*c* is manipulated, the moderately operating motor 8 is rotated continuously or steppingly. However, the control device controls the motor 8 in such a way that the continuous or stepping operation of the motor 8 is caused only by manipulation of the push button switch 6*c*, irrespective of the conditions of the mat switches 1*a*, 1*b*. The rotational speed of the moderately operating motor 8 which rotates the blanket cylinders 18, 19 and the plate cylinders 20, 21, is greatly lower than that of the main motor 7, and accordingly, even if the operator exist at a position between one of the ink device units 15, 16 and the printing machine body 13, confronting either one of the cylinders 18, 19, 20, 21, that is, a position where any of the mat switches 1*a*, 1*b* is turned on, there is substantially no possibility of occurrence of a risk. It is, rather, necessary that the operators stay at positions at which the mat switches are turned in order to moderately or steppingly rotate the cylinders 18, 19, 20, 21 on during preparation of printing such as replacement of printing plates or positioning. The transmission of torques of the main motor 7 and the moderately operating motor 8 to the cylinders 18, 19, 20, 21 is changed over by means of suitable transmission changeover means such as electromagnetic clutches or the like which are not shown.

According to the arrangement of this embodiment, the presence of the operators in rear of the ink device units 15, 16 is detected by the mat switches 2*a*, 2*b* which are turned on, while the presence of the operators in front of the ink device units 15, 16 are detected by the mat switches 1*a*, 1*b* which are turned on. Further, in these cases, the advance and the retraction of the ink device unit 15, 16 are inhibited even though the push button switches 5*a*, 5*b* are operated.

When the ink device units 15, 16 are apart from the printing machine body 13, if an operator is positioned between the ink device units 15, 16 and the printing machine body 13, confronting the cylinders 18, 19, 20, 21, that is, positioned in front of the ink device units 15, 26, the mat switches 1*a*, 1*b* detect this matter so as to inhibit the drive of the main motor 7. Accordingly, even though the push button switches 6*a*, 6*b* are operated in this condition, the main motor 7 is not rotated. Meanwhile, when the push button 6*c* is operated, the moderately operating motor 8 is rotated even though the mat switches 1*a*, 1*b* are energized, and accordingly, the cylinders 18, 19, 20, 21 are moderately or steppingly rotated.

It is a matter of course that switches other than the mat switches 1*a*, 1*b*, 2*a*, 2*b* which can detect the presence of an operator in front or rear of the ink device units 15, 16, as explained above, having functions similar to the latter may be also used instead.

Further, in the above-mentioned embodiment, it has been explained that the drive of the moving devices 4*a*, 4*b* is inhibited only when an operator is positioned in the direction of advance of the ink device unit 15 or 16. However, the inhibition of the drive of the moving devices 4*a*, 4*b* may be made, irrespective of the directions of movement of the ink device units 15, 16, when any one of the mat switches 1*a*, 1*b*, 2*a*, 2*b* is operated.

With the arrangement according to the present invention, as specifically explained hereinabove, when an operator is positioned between the ink device units and the printing machine body, the drive of the main motor is inhibited, and accordingly, accidents such as that the operator is caught by the cylinders in the printing machine body, can be prevented.

Further, with the arrangement according to the present invention, when an operator is positioned in the direction of advance of the ink device unit, the movement of the latter is inhibited, and accordingly, accidents such as that the operator is caught by the ink device unit on movement, can be prevented.

What is claim is:

1. A safety system for a printing press comprising a horizontally stationary printing head, including at least one pair of printing cylinders, at least one inking unit mounted for movement between an advanced operative position relative to said printing head, and, a retracted position relative to said printing head, a first high-speed motor for driving said pair of cylinders, bi-directional drive means for advancing and retracting said inking unit, and a third low-speed motor for indexing said printing head during set-up and servicing of said printing head;

a first sensor operative to detect the presence of an operator and tools interposed between said printing head and said inking unit when said inking unit is other than in a fully advanced position;

a second sensor operative to detect the presence of an operator and tools positioned behind said inking unit when said inking unit is other than in a fully retracted position; and, a switching control operatively connected to said first high speed motor, to said second inking unit advancing and retracting drive means, to said third low speed indexing motor, to said first sensor, and, to said second sensor;

said switching control permitting selective operation of said low speed indexing motor; said switching control having means selectively operable to enable said first motor in the absence of actuation of said first sensor;

said switching control means being operative to disable said drive means in the retract direction in the presence of actuation of said second sensor, while permitting operation of said drive means in the advance direction in the absence of actuation of said first sensor; and, said switching control means being operative to disable said drive means in the advance direction in the presence of actuation of said first sensor, while permitting operation of said drive means in the retract direction in the absence of actuation of said second sensor.

2. The safety system of claim 1, including dual said horizontally moveable inking units respectively arranged on opposite sides of said printing head, and including dual said drive means, dual said first sensors, and dual said second sensors, each connected to said switching control and respectively associated with respective ones of the first and the second of said inking units.

3. The safety system of claim 1, in which said first and second sensors are comprised by mat switches, which are operated in the presence of a weight placed thereon.

4. A safety system for a printing press having a horizontally stationary printing head including at least one pair of cylinders, at least one inking unit mounted for movement between an advanced operative position relative to said printing head, and a retracted position relative to said printing head, a first high-speed motor for driving said pair of cylinders, and a second low-speed motor for indexing said at least one pair of cylinders, said safety system further comprising a first sensor operative to detect the presence of an operator and tools interposed between said printing head and said inking unit when said inking unit is other than in a fully advanced position; and a switching control operatively connected to said first high speed motor, to said second low speed indexing motor, and to said first sensor wherein said switching control is operative to disable said first motor in the presence of actuation of said first sensor, and said switching control is operative to enable said second low speed indexing motor, in the presence of actuation of said first sensor.

5. A safety system for a printing press having a horizontally stationary printing head including at least one pair of cylinders, at least one inking unit mounted for movement between an advanced operative position relative to said printing head and a retracted position relative to said printing head, and di-directional drive means for advancing and retracting said inking unit, said safety system further comprising a first sensor operative to detect the presence of an operator and tool interposed between said printing head and said inking unit when said inking unit is other than in a fully advanced position, a second sensor operative to detect the presence of an operator and tools positioned behind said inking unit when said inking unit is other than in a fully retracted position, and a switching control operatively connected to said bi-directional drive means to said first sensor and to said second sensor, wherein said switching control is operative to disable said bi-directional drive means in the advance direction in the presence of actuation of said first sensor, while permitting operation of said bi-directional drive means in the retract direction in the absence of actuation of said second sensor and said switching control is operative to disable said drive means in the retract direction in the presence of actuation of said second sensor, while permitting operation of said drive means in the advance direction in the absence of actuation of said first sensor.

6. A safety system for a printing press having a horizontally stationary printing head including at least one pair of cylinders, at least one inking unit mounted for movement between an advanced operative position relative to said printing head, and a retracted position relative to said printing head, a first high-speed motor for driving at least said pair of cyclinders, bi-directional drive means for advancing and retreating said inking unit and a second low-speed motor for indexing said at least one pair of cylinders, said safety system further comprising:

a first sensor operative to detect the presence of an operator and tools interposed between said printing head and said inking unit when said inking unit is other than in a fully advanced position;

a second sensor operative to detect the presence of an operator and tools positioned behind said inking unit when said inking unit is other than in a fully retracted position, and a switching control operatively connected to said first high speed motor, to said second low speed indexing motor, to said first sensor, to said second sensor and to drive means, wherein said switching control is operatively to disable said first motor in the presence of actuation of said first sensor, said switching control is operative to enable said second low speed indexing motor, said switching control is operative to disable said drive means in the advance direction in the presence of actuation of said first sensor, while permitting operation of said drive means in the retreat direction in the absence of actuation of said second sensor, and said switching control is operative to disable said drive means in the retreat direction in the presence of actuation of said second sensor, while permitting operation of said drive means in the advance direction in the absence of actuation of said first sensor.

* * * * *